United States Patent [19]

Latham

[11] Patent Number: 5,006,086

[45] Date of Patent: Apr. 9, 1991

[54] HYDRAULIC POWER SYSTEM FOR OUTBOARD MOTOR

[76] Inventor: Robert P. Latham, 280 SW. 32nd Ct., Fort Lauderdale, Fla. 33315

[21] Appl. No.: 495,624

[22] Filed: Mar. 19, 1990

[51] Int. Cl.[5] ..... B63H 21/10

[52] U.S. Cl. ..... 440/88; 440/900

[58] Field of Search ..... 440/88, 900, 61, 76; 415/177; 417/52, 211.5, 360, 363, 367, 310, 313; 418/154

[56] References Cited

U.S. PATENT DOCUMENTS 4,300,872 11/1981 Brown et al. ..... 440/76 X 4,689,025 8/1987 Ferguson ..... 440/61

*Primary Examiner*—Ed Swinehart

*Attorney, Agent, or Firm*—Alvin S. Blum

[57] ABSTRACT

A compact, integral hydraulic power assembly is provided for mounting above the flywheel of an outboard marine engine. The hydraulic pump couples in coaxial alignment with the crankshaft of the engine. The hydraulic pump is surrounded by an annular hydraulic fluid reservoir with a cooling element having a channel for flowing cooling water to cool the hydraulic fluid. A special rigid coupling between the pump shaft and the flywheel/crankshaft and a resilient coupling of the reservoir housing to the engine ensures correct alignment without adjustment.

6 Claims, 3 Drawing Sheets

HYDRAULIC POWER SYSTEM FOR OUTBOARD MOTOR

This invention relates to marine propulsion device power steering systems, and more particularly to arrangements for pumping hydraulic fluid to power steering systems for marine outboard motors.

BACKGROUND OF THE INVENTION

U.S. Pat. Nos. 4,689,025 issued Aug. 25, 1987 and 4,749,374 issued Jan. 7, 1988 to Ferguson disclose a hydraulic power steering system for an outboard motor and U.S. Pat. No. 4,695,261 issued Sept. 22, 1987 to Broughton et al is directed to the location of the power take off pulley for driving the hydraulic pump for that power steering system.

That system employs the conventional teaching of using a power take off pulley attached to one end of the drive shaft to drive a hydraulic pump mounted adjacent the engine block through an endless belt.

Broughton discusses the problems associated with mounting a drive pulley directly on the crankshaft in lengthening the driveshaft. In an outboard motor, it is conventional teaching that nothing should be added to increase the height of the motor as shown by Broughton's teaching of the drive pulley radially surrounding the flywheel.

U.S. Pat. Nos. 3,282,222 issued Nov. 1, 1966 to Raufeisen; 4,229,980 issued Oct. 22, 1980 to Kingston; and 4,272,224 issued Jun. 9, 1981 to Kabele discuss the problems associated with direct coupling of a driven rotary shaft to a driving shaft.

High power outboard motors require considerable steering effort. It may be useful to provide a power steering system, using a power take off from the engine to drive a hydraulic pump. Hydraulic power may be useful for other purposes such as winches. Because the power head is so large in a high power outboard, it is difficult to find room inside the engine cover to install the necessary elements of a hydraulic steering system of the prior art including the driving pulley at the flywheel end of the crankshaft, the driven pulley, endless belt between the pulleys, the hydraulic reservoir, the hydraulic pump and the hydraulic fluid cooler. The prior art teaching is to install the hydraulic fluid cooler below the power head, the driving pulley mounted below the flywheel and surrounding the voltage generator so as to not extend the overall height of the engine, and the hydraulic pump, reservoir and driven pulley arranged vertically alongside the engine block, with the reservoir atop the pump.

SUMMARY OF THE INVENTION

The invention comprises a compact hydraulic power system for direct coupling to the crankshaft above the flywheel on top of the power head of an outboard motor. The hydraulic fluid reservoir is an annulus surrounding the hydraulic pump and the hydraulic fluid is cooled by contact with a metal channel in the reservoir through which cooling water flows. By arranging the fluid reservoir and cooling channel to surround the hydraulic pump, an integral assembly is provided of limited vertical height with a unique arrangement for coupling to the crankshaft that requires no modification of the flywheel. It is an object of the invention to provide a compact unitary hydraulic power assembly that mounts atop the flywheel of an outboard motor with direct coupling to the crankshaft that provides fluid connections for high and low pressure hydraulic fluid and cooling water inlet and outlet for ease of installation and compact structure. A unique coupling and mounting arrangement ensures proper coaxial alignment without the need for adjustment at installation.

These and other features, objects and advantages of the invention will become more apparent when the drawings are considered in conjunction with the detailed description.

DETAILED DESCRIPTION OF THE PREFERRED EMBODIMENT

Figure 1:
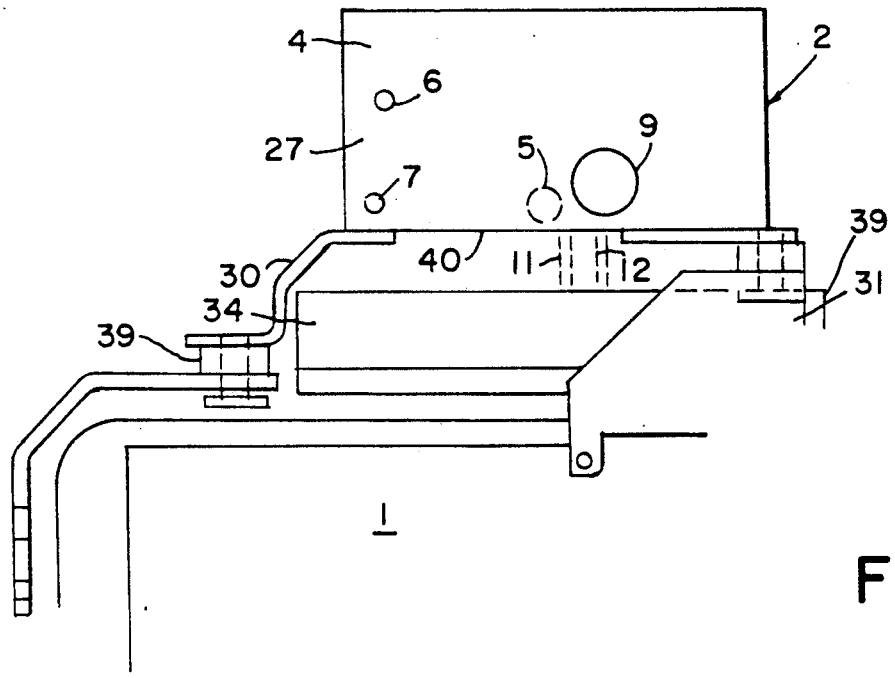
FIG. 1 is a front elevation view of the hydraulic assembly.
Figure 2:
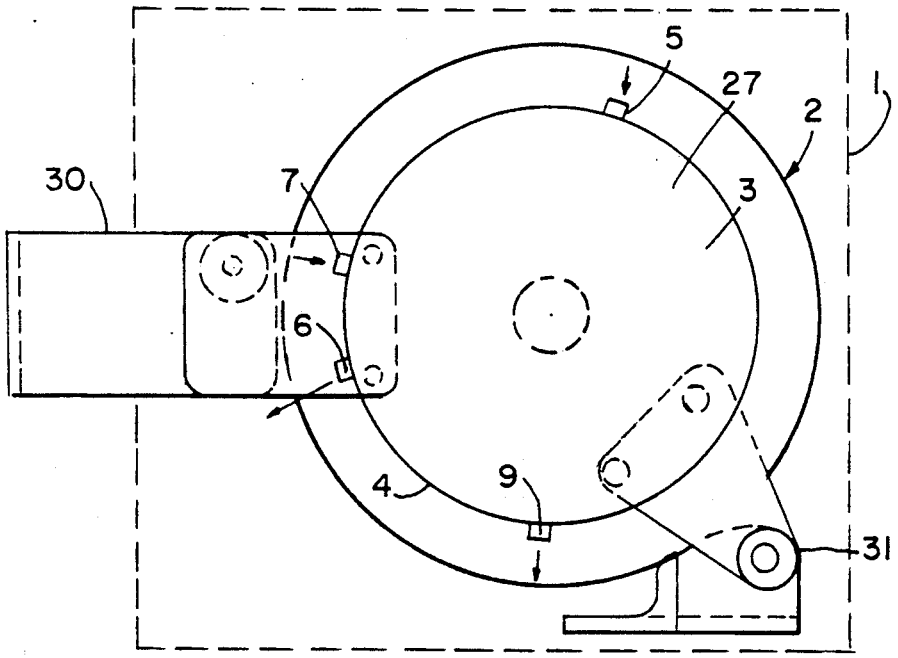
FIG. 2 is a top view of the hydraulic assembly.
Figure 3:
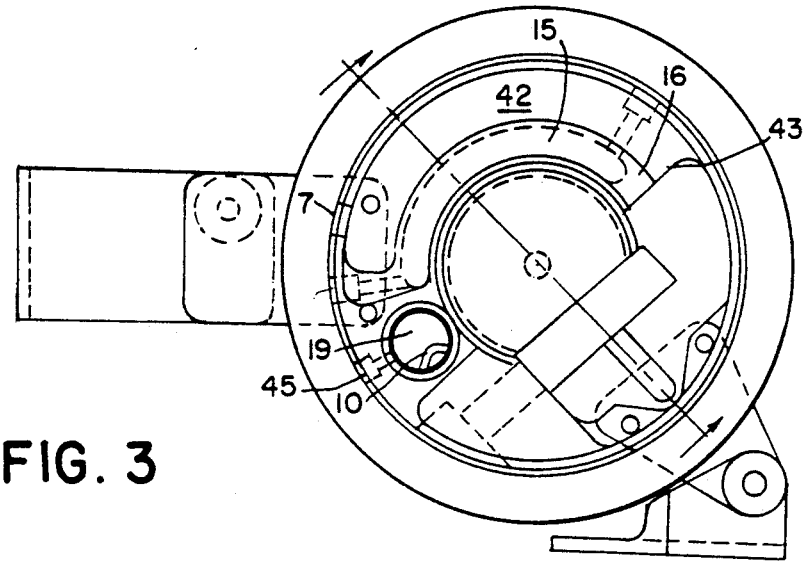
FIG. 3 is a top view as in FIG. 2 with cover plate removed.
Figure 4:
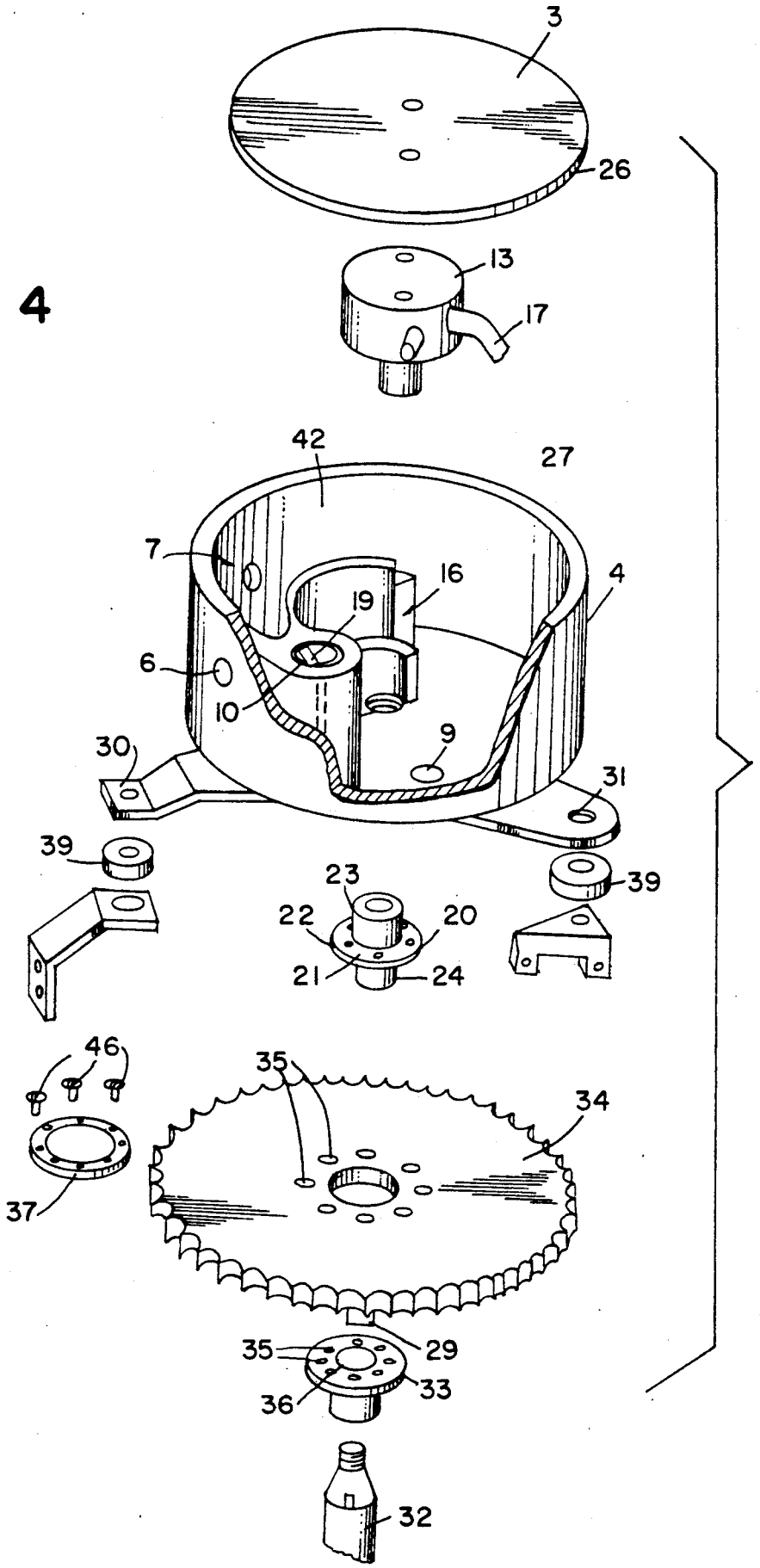
FIG. 4 is an exploded perspective view, partially broken away, of the hydraulic assembly on a crankshaft.

Referring now first to FIGS. 1, 2 and 4, the hydraulic power assembly 2 of the invention is mounted by mounting attachments 30 and 31 to the outboard engine powerhead 1. Mounting attachments 30, 31 include resilient members 39 so that the attachment is not rigid.

The attachments are affixed to the bottom wall 40 of hydraulic fluid reservoir 27 that has outer cylindrical wall 4 and sealed top cover 3 and contains the hydraulic pump and water cooling means. Extending below the bottom wall 40 is hydraulic pump shaft 12 that fits into coupling 11 by a press fit. The coupling 11 couples the hydraulic pump to the top of flywheel 34 and the top of the crankshaft 32 of the engine, best seen in FIG. 5.

Installation on an outboard engine is extremely simple. The coupling is bolted in place using existing bolt holes on the flywheel. The assembly is positioned over the coupling and the shaft of the pump is pressed into the coupling. Then the mounting attachments are bolted onto the engine block using existing bolt holes. The coupling arrangement ensures that the pump shaft is coaxially aligned with the crankshaft so that there is no unbalance or stresses placed on the engine or the pump. The resilient mounting elements connected to the reservoir hold the pump housing and reservoir against rotation without disturbing the alignment of the pump shaft.

Cover 3 sealed with O ring 26 seals hydraulic fluid in reservoir 27. Centrally positioned within reservoir 27 is pump housing 13 with fluid intake 17 that extends into reservoir 27 to pick up fluid and high pressure outlet 9 that extends through the wall 4 of the reservoir to provide high pressure hydraulic fluid to power hydraulic steering cylinders, winches and the like. Within the pump housing 13, pump shaft 12 is journaled with bearings 41. Impeller 14 is affixed to the shaft and rotates within the housing 13. The impeller may be any of the hydraulic pump impellers well known in the art. A moving vane type impeller has been found useful. The pump intake 17 aspirates fluid from an annular space surrounding the pump housing. Since considerable heat is generated by the pumping of fluid, effective and compact cooling of the hydraulic fluid by a flow of cooling water taken from the engine cooling water supply has been incorporated into the reservoir assembly, with greatest cooling being applied to the hot portion of fluid, i.e. the fluid entering the reservoir, for greatest efficiency of cooling. It is well known that the greatest heat transfer occurs when the temperature difference between fluids is greatest.

An arcuate cooling tower 16 partitions off a portion of the reservoir into an inlet channel 42 open to the reservoir at one end 43 and communicating with hydraulic fluid return connector 7 at the other end. When the hot hydraulic fluid returns to the assembly it flows through this inlet channel 42 and beside cooling tower 16 before entering the large volume portion of the reservoir at the outlet 43 of the inlet channel.

A cooling water channel 15 within the cooling tower 16 is supplied with a flow of cooling water through inlet 5 and outlet 6. Since the walls are metal, there is effective heat transfer from the hot hydraulic fluid. An expansion chamber 19 has a tubular input 10 that extends from the top of the reservoir to the bottom of the chamber 19 with air vent 45 that provides for expansion and contraction of the fluid like the radiator coolant overflow chamber in automobiles.

Figure 5:
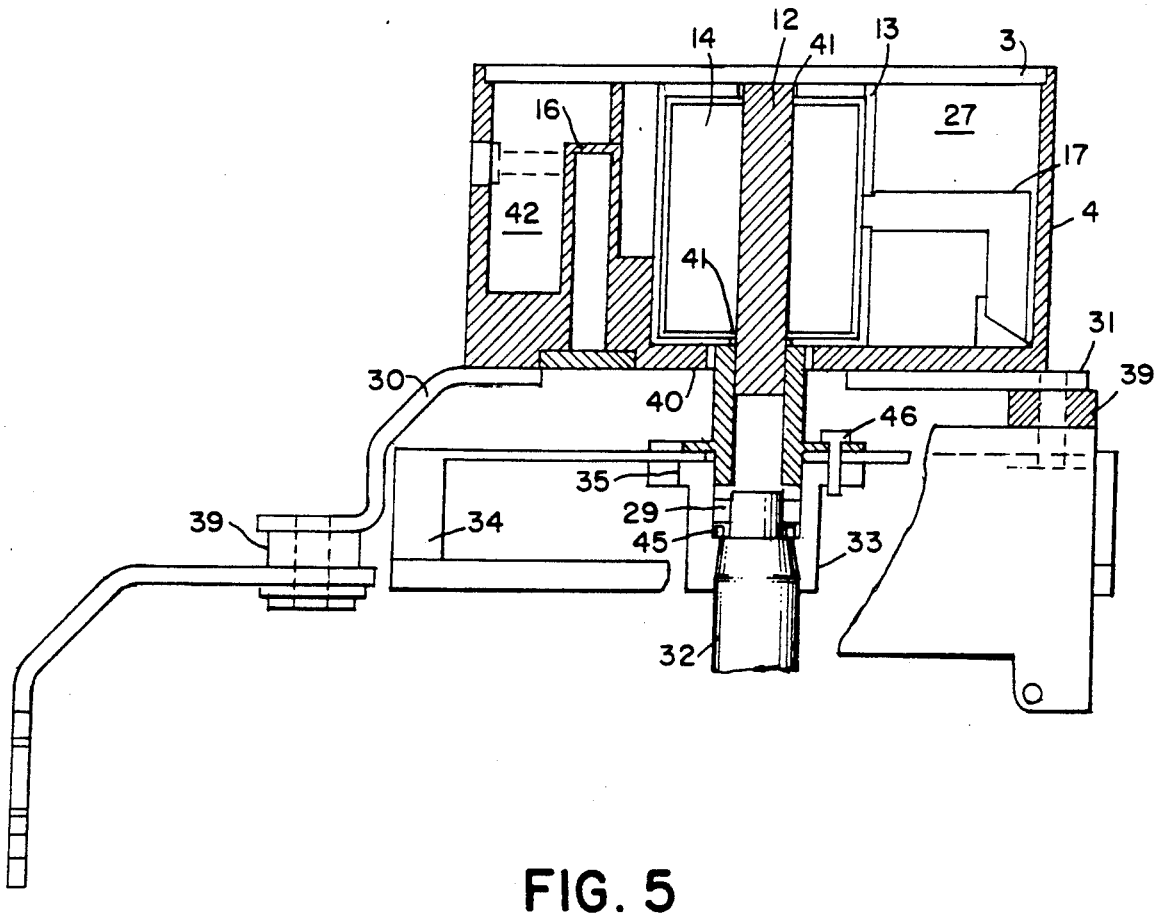
FIG. 5 is a sectional view taken through the line A—A of FIG. 3.

The coupling arrangement to the engine crankshaft 32 and flywheel 34 is best seen in FIGS. 4 and 5. A typical outboard engine has a crankshaft 32. A flywheel adapter 33 is held in place with washer 45 and nut 29. Flywheel 34 is bolted to adapter 33 through ring washer 37 with bolts 46 in bolt holes 35. To retrofit the engine for mounting the hydraulic power assembly 2, the bolts 46 and ring washer 37 are removed and coupling 20 installed. Coupling 20 has a bottom portion 24 with an external thread that matches the internal thread 36 normally provided on adapter 33 for lifting the engine. Coupling 20 has a central flange 21 with bolt holes 22 to correspond to bolt holes 35 in the flywheel 34 and adapter 33. The coupling 20 is screwed into the adapter 33 and the bolt holes on flywheel, adapter and coupling aligned. The three are then bolted together with bolts 46. The screw threads align the coupling coaxially with the crankshaft and the bolts ensure coupled rotation without vibration. The upper portion 23 of the coupling 20 has a concentric hole to receive the shaft 12 of the hydraulic pump in a simple press fit requiring no disassembly or adjustment of the hydraulic power assembly.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A compact, integral hydraulic power assembly for mounting on top of the engine block of a marine propulsion unit having a flywheel at the upper end of a vertical crankshaft, said assembly comprising:

(a) a vertical pump shaft arranged for operatively coupling with coupling means to said crankshaft in coaxial alignment;

(b) hydraulic pump impeller means for pumping hydraulic fluid fixedly connected to said pump shaft;

(c) pump housing means for enclosing said impeller means, said housing means defining a fluid space with low pressure inlet and high pressure outlet, said pump shaft being journaled in said housing means;

(d) a fluid reservoir means for storing a substantial amount of hydraulic fluid to be pumped, said reservoir means arranged in an annulus around said pump housing means, and said reservoir means in fluid communication with said low pressure inlet of said pump housing means; and (e) resilient connecting means attached to said reservoir means for connecting said hydraulic power assembly to said engine block while maintaining said coaxial alignment.

2. The hydraulic power assembly according to claim 1, further comprising a cooling water channel means having an inlet and an outlet for connection to a supply of flowing cooling water, said cooling water channel means and said reservoir means sharing at least one common thermally-conductive wall for cooling said hydraulic fluid.

3. The hydraulic power assembly according to claim 1, in which said coupling means comprises a shaft having a first and a second end and an intermediate portion provided with a flange, said first end having means for engaging said crankshaft, said second end having means for engaging said pump shaft and said flange having means for engaging said flywheel.

4. The hydraulic power assembly according to claim 3, further comprising a cooling water channel means having an inlet and an outlet for connection to a supply of flowing cooling water, said cooling water channel means and said reservoir means sharing at least one common thermall-conductive wall for cooling said hydraulic fluid.

5. The hydraulic power assembly according to claim 1, in which said reservoir means includes an inlet channel means for receiving a flow of incoming hydraulic fluid and a cooling water channel means having an inlet and an outlet for connection to a supply of flowing cooling water, wherein said inlet channel means and said cooling water channel means are juxtaposed and separated from one another by thermally-conductive partition means for enhanced heat transfer.

6. The hydraulic power assembly according to claim 1, further comprising overflow chamber means in fluid communication with said reservoir means for compensating for expansion and contraction of said hydraulic fluid with heating and cooling.

* * * * *